US005778904A

United States Patent [19]

Elsner

[11] Patent Number: 5,778,904

[45] Date of Patent: Jul. 14, 1998

[54] HAIR TIE FASTENER

[76] Inventor: Susan C. Elsner, 9019 Georgia Ave. N., Brooklyn Park, Minn. 55445

[21] Appl. No.: 790,727

[22] Filed: Jan. 27, 1997

[51] Int. Cl.[6] ..... A45D 8/16; A45D 8/36

[52] U.S. Cl. ..... 132/275; D28/41

[58] Field of Search ..... 132/212, 273, 132/275; D28/41, 42, 43

[56] References Cited

U.S. PATENT DOCUMENTS

| | | | |
|---|---|---|---|
| D. 229,240 | 11/1973 | Fox | D28/41 |
| 537,542 | 4/1895 | Moore | 132/273 |
| 1,241,337 | 9/1917 | Breitenstein . | |
| 2,488,954 | 11/1949 | Winters | 132/275 |
| 2,845,670 | 8/1958 | Brown et al. . | |
| 2,953,827 | 9/1960 | Patterson . | |
| 3,081,781 | 3/1963 | Stermer . | |
| 3,099,271 | 7/1963 | Dubelier . | |
| 3,751,769 | 8/1973 | Reiner | 132/273 |
| 5,036,870 | 8/1991 | Edmark . | |
| 5,167,245 | 12/1992 | Harriett . | |
| 5,289,834 | 3/1994 | Lawrence . | |
| 5,379,782 | 1/1995 | Tabb | 132/275 |
| 5,388,598 | 2/1995 | Whitten | 132/275 |
| 5,404,892 | 4/1995 | Bret | 132/275 |
| 5,417,230 | 5/1995 | Wood . | |

*Primary Examiner*—Paul J. Hirsch
*Attorney, Agent, or Firm*—Janet Peyton Schafer

[57] ABSTRACT

A tie fastener having an elastomeric cord formed into a loop by passing the terminal ends of the cord through a compression spring actuated cord lock. A stop bead positioned on the loop prevents the loop end of the elastomeric cord from inadvertently being removed from the cord lock. Pendant beads affixed to the terminal ends of the cord prevent the cord from inadvertently being pulled out of the cord lock.

10 Claims, 1 Drawing Sheet

HAIR TIE FASTENER

BACKGROUND

A hair tie fastener that relates generally to tie fasteners and particularly to fasteners for hair ties or the like.

Naked rubber bands have been used as hair fasteners but they damage the hair by breaking multiple hairs leaving hair of differing and undesired shorter lengths.

Covered rubber bands have been used as hair fasteners, and while they damage the hair less, they do not work well with small amounts of hair. Dexterity is required to install them in their place of use, limiting its usefulness for small children and they have limited decorative value.

Cloth covered fasteners, commonly called "scrunchies", cause less damage to hair than do either naked or covered rubber bands, however, again they do not work well with small amounts of hair. Commonly, these "scrunchies"are used in conjunction with rubber bands, covered or otherwise.

Barrettes, clips, combs, and hair pins have all been used to restrain hair, however, they are not useful for physically active users because they come undone from the hair.

For the foregoing reasons there is a need for a hair tie fastener that can efficiently be used on any amount of hair, on hair of any thickness, even baby fine hair, and does not damage the hair on which it is used, can be used even during great physical activity of the wearer, is decorative and can be inexpensively manufactured.

SUMMARY

The present invention is directed to a hair tie fastener that satisfies these needs for a hair fastener that can be successfully used on even baby fine hair, and small amounts of hair, that does not damage the hair, stays in place even during great physical activity of the wearer, is decorative and is inexpensively manufactured. A hair tie fastener having features of the present invention comprises a predetermined length of cord, the terminal ends of which are received by a cord lock forming a loop generally in the middle of the cord. A stop bead is threaded onto the cord loop preventing the cord loop from being pulled through the cord lock when the lock is in its first, unlocked, position releasing the cord.

Means are provided to push the cord lock away from the terminal ends of the cord shortening the cord loop about the hair or other object to be fastened.

The cord lock comprises a generally spherical shaped body having an open end and a closed end. A pair of apertures are formed in opposite side walls of the open end of the body. A button is received by the open end of the body, the button having a flat, proximal, surface that is manually depressed, and a pair of openings formed in opposite side walls of the button. A compression spring is retained within the body, a first end of which is attached to the distal end of button and a second spring end attached to the inside of the closed end of body attaching button to body. The compression spring attaches the button to the cord lock and also urges the button to a locked position. Pressure applied to the flat proximal surface of the button compresses the compression spring resulting in the retreating of the button into the body such that the button openings are aligned with the body apertures, unlocking the cord lock, permitting the cord to be moved within the cord lock. The cord lock may now be repositioned on the cord. Release of pressure upon the flat proximal surface of the button misaligns the apertures and openings, resulting in the locking in place of the cord lock on the cord.

BRIEF DESCRIPTION OF THE DRAWINGS

Understanding of the invention will be enhanced by referring to the accompanying drawings, in which like numbers refer to like parts in the several views and in which.

DETAILED DESCRIPTION OF THE CURRENTLY PREFERRED EMBODIMENTS

Understanding of the invention will be further enhanced by referring to the following illustrative but nonlimiting example. Definitions: misalign means to put out of alignment.

A tie fastener having a length of cord, the two terminal ends of which are fed into and received by a cord lock, forming a loop generally in the middle section of the cord. A stop bead prevents the cord loop from being inadvertently removed from the cord lock. Pendant beads, attached to each of the terminal ends of the cord after the cord is received by the cord lock, prevent the cord terminal ends from being inadvertently removed from the cord lock.

Figure 1:
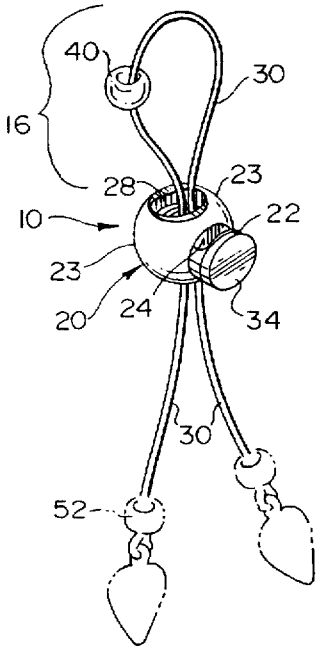
FIG. 1 is a perspective view of a hair care accessory.

Turning now to the drawings, in which like reference characters refer to corresponding elements throughout the several views, FIG. 1 illustrates a tie fastener 10 having a predetermined length of cord 30, the terminal ends of which are fed into a cord lock 20, forming a loop 16 generally in the middle section of the cord 30. In actual use conditions, elastomeric cord, which may be colored, having a diameter of either one eighth (0.3175cm) or one sixteenth inch (0.15875cm), or in a range between, has been used although other diameter elastomeric cord could be used so long as it may be received by both the cord lock and any bead used. Natural fiber cord or nylon cord may be used, although elastomeric cord is preferred because being able to stretch the cord 30 longitudinally while tightening the cord lock 20 enables the user to more tightly fasten the tie fastener 10 about the object to be fastened. Where that object to be fastened is human hair, the elastomeric cord 30 enables a tight fastening of the tie fastener 10 about a tuft of human hair, preventing hair from falling out of the tie fastener 10.

Cord lock 20, as shown in these figures, has a generally spherical shaped body 26, although other body shapes, such as cylindrical, square, or rectangular, could be used. In actual use conditions, cord lock 20 is of hard plastic although other suitable materials, such as ceramic, and wood, could be used.

Figure 2:
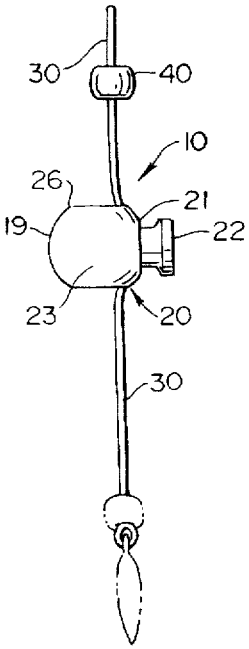
FIG. 2 is a right side elevational view thereof.
Figure 5:
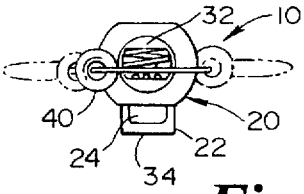
FIG. 5 is a top plan view thereof.
Figure 6:
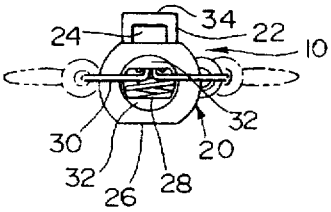
FIG. 6 is a bottom plan view thereof.
Figure 7:
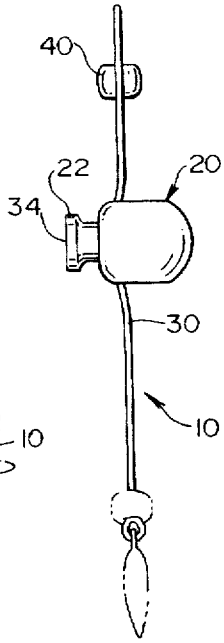
FIG. 7 is a left side elevational view thereof.

Body 26 has an open end 21 and a closed end 22, as shown at FIG. 2, providing side walls 23 adjacent the open end 21. A pair of apertures 32 are formed in opposite sides of said side walls 23, as shown in FIGS. 5 & 6. A button 22, of a size to be received by the body open end 21, is provided. Button 22 is generally cylindrical in shape, having a proximal surface 34 for being manually pushed. Button 22 has a pair of openings 24 formed in side walls thereof, shown at FIGS. 5 & 6. A compression spring 28, as shown at FIGS. 5 & 6, is attached at a first end to the distal end of button 22 and at a second end to the inside of the closed end of body 26. In this manner, button 22 is attached to cord lock body 26. Pressure received on proximal surface 34 of button 22 compresses compression spring 28 such that button 22 is urged to a first, unlocked position, in body 26. In this first unlocked position, button openings 24 are aligned with body apertures 32 forming an orifice therethrough for receiving both terminal ends of cord 30. When pressure is removed from the proximal surface 34 of button 22, the compression spring 28 expands to its normal position such that openings 24 and apertures 32 are no longer in alignment spring 28 urging button 22 to a second, locked, position, as shown at FIGS. 5 & 6, locking cord 30 in cord lock 20.

Figure 3:
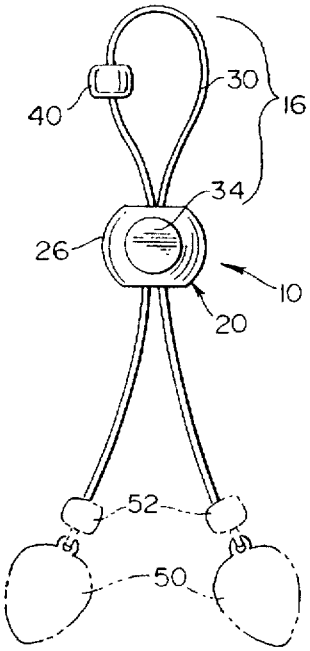
FIG. 3 is a front elevational view thereof.
Figure 4:
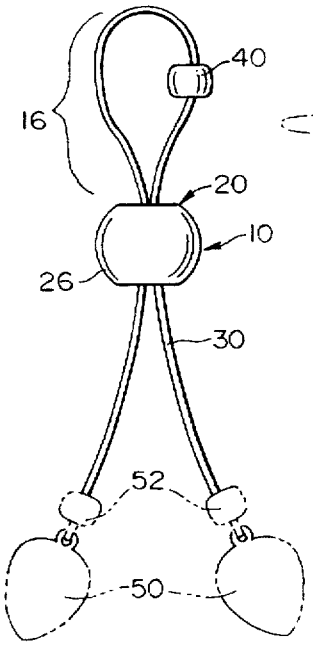
FIG. 4 is a rear elevational view thereof.

A stop bead 40 is provided at the loop end of cord 30, shown at FIGS. 1,3, & 4, to prevent cord 30 from inadvertently being pulled out of cord lock 20 when button 22 is in a first, unlocked, position where apertures 32 and openings 24 are in their aligned position. In actual used conditions, acrylic bead has been use although other materials could be used including ceramics, and wood. After cord 30 is fed through cord lock 20, pendant beads 50, shown in phantom, may be attached by any means to the terminal ends of cord 30 to prevent inadvertently pulling cord 30 out from cord lock 20 when button 22 is in a first, unlocked position, where apertures 32 and openings 24 are in their aligned position. In actual use conditions, acrylic pendant beads 50 have been used although other materials, including ceramics and wood, could be used.

Tie fastener 10 is made by inserting one terminal end of cord 30 into cord lock 20 when button 22 is pressed to a first, unlocked position, providing an orifice through cord lock 20. Stop bead 40 is threaded onto cord 30 by means of a second terminal end of cord 30, then this second end is inserted into cord lock 20 such that both terminal ends of cord 30 extend out the opposite side of cord lock 20. Button 22 is released, urged by compression spring 28 to a second, locked, position, locking cord 30 into place in cord lock 20. A pendant bead 50 is attached to each terminal end of cord 30. In actual use conditions, each pendant bead 50 is positioned on cord 30 and a metal crimp, not shown, is used to fasten pendant bead 50 in place. Pendant bead 50 is then adhered to the crimp with glue or other fastening means. The cord 30 may also be formed into a small loop around pendant bead 50 and the end attached to the cord 30 by metal crimp, or the metal crimp may be attached onto the terminal end of the cord 30 and crimped into place. Other means of attaching a pendant bead 50 to the terminal ends of cord 30 are included, including tying a knot in each terminal end of cord 30. Additional decorative beads 52, shown in phantom, may be positioned onto cord 30 before the pendant beads 50 are attached.

In use, the loop 16 of tie fastener 10 is expanded to its largest size or at least to a size larger than the hair, or other material, to be fastened by depressing button 22 on cord lock 20 and manually moving cord lock 20 to a position adjacent the pendant beads 50. Hair, or other material, is inserted through the loop 16. Button 22 is again depressed and cord 30 is longitudinally stretched and withdrawn through cord lock 20 until loop 16 is tight about the hair of other material. Use of elastomeric cord 30, which may be longitudinally stretched, enables a tight fit of tie fastener 10 about hair. Once tie fastener 10 is in the desired position, button is released enabling the cord lock 20 to lock the cord 30 in place about the hair or other material.

Tie fastener 10 may be removed by reversing the above steps.

An advantage of the tie fastener 10 of the present invention is that it may be successfully used on even baby fine hair and where there is a minimal amount of hair or other material to be fastened. Numerous types of decorative beads may be attached to tie fastener 10. Tie fastener 10 is easy to use and inexpensive to manufacture.

Although the present invention has been described in considerable detail with reference to certain preferred versions thereof, other versions are possible. Therefore, the spirit and scope of the appended claims should not be limited to the description of the preferred versions contained herein.

What is claimed is:

1. A tie fastener, comprising:

a) a predetermined length of cord, having a pair of terminal ends;

b) a cord lock, having a first, unlocked position, such that said terminal ends are received by said cord lock, forming an elongated loop generally in the middle portion of said cord, and said cord lock having a second, locked position, whereby said cord is locked in position in said cord lock;

c) said stop bead threaded onto said cord, said stop bead positioned such that when said cord is formed into a loop, said stop bead is positioned on said loop preventing said loop from being pulled through said cord lock when said cord lock is in said first, unlocked position; and d) means for decreasing the size of said loop.

2. The tie fastener of claim 1, wherein said cord further comprises elastomeric cord.

3. The tie fastener of claim 1, wherein said cord lock further comprises:

a) a hollow body having a blind end formed therein;

b) a pair of apertures formed in opposite side walls of said body;

c) a button received by said hollow body, said button having a proximal surface and a pair of openings formed in opposite side walls of said button;

d) a compression spring retained within said body, a first end of which abuts the blind end of said body, and a second end of which is attached to a distal end of said button retaining said button within said body, such that pressure applied to said proximal surface of said button compresses said compression spring withdrawing said button into said body such that said cord lock is in said first, unlocked position, where said button openings are aligned with said body apertures, permitting said cord to be moved within said cord lock, repositioning said cord in a predetermined position, release of pressure upon said button such that said cord lock is in said second, locked position, wherein said apertures and openings are misaligned, resulting in the locking in place of said cord within said cord lock.

4. A hair tie fastener, for fastening about multiple strands of hair, comprising:

a) a predetermined length of elastomeric cord, having a pair of terminal ends;

b) a cord lock, having a first, unlocked position, such that said terminal ends are received by said cord lock, forming a loop generally in the middle portion of said cord, and said cord lock having a second, locked position, whereby said cord is locked in position in said cord lock;

c) said stop bead threaded onto said cord, said stop bead positioned such that when said cord is formed into a loop, said stop bead is positioned on said loop preventing said loop from being pulled through said cord lock when said cord lock is in a first, unlocked position; and d) means for decreasing the size of said elongated loop.

5. The hair tie fastener of claim 4, wherein said cord lock further comprises:

a) a hollow body having a blind end formed therein;

b) a pair of apertures formed in opposite side walls of said body;

c) a button received by said hollow body, said button having a flat proximal surface and a pair of openings formed in opposite side walls of said button;

d) a compression spring retained within said body, a first end of which abuts the blind end of said body, and a second end which is attached to a distal end of said button retaining said button within said body, such that pressure applied to said proximal surface of said button compresses said compression spring withdrawing said button into said body such that said cord lock is in said first, unlocked position, where said button openings are aligned with said body apertures forming an orifice therethrough, permitting said cord to be moved within said cord lock, repositioning said cord in a predetermined position, release of pressure upon said button such that said cord lock is in said second, locked position, wherein said apertures and openings are misaligned, resulting in the locking in place of said cord within said cord lock.

6. The hair tie fastener of claim 5, further comprising a pendant bead attached to each of said terminal ends preventing said cord from being drawn back through said cord lock when said cord lock is in its first, unlocked position.

7. The hair tie fastener of claim 6, further comprising manually pushing said cord lock, when in its first, unlocked position, along said cord to enlarge or decrease size of said elongated loop.

8. A hair tie fastener, for fastening about multiple strands of hair, comprising:

a) a length of elastomeric cord having a pair of terminal ends;

b) a cord lock which receives said pair of terminal ends of said cord, forming an elongated loop generally in the middle of said cord;

c) said stop bead threaded onto said cord, said stop bead positioned such that when said cord is formed into an elongated loop, said stop bead is positioned on said loop preventing said loop from being pulled through said cord lock when said cord lock is in a first, unlocked position;

d) means for pushing said cord lock away from said terminal ends of said cord, shortening said loop about the hair to be fastened; and e) a pair of pendant beads, one fastened to each terminal end of said cord for preventing said cord from inadvertently slipping out of said cord lock.

9. The tie fastener of claim 8, wherein said cord lock further comprises a) a hollow body having a blind end formed therein;

b) a pair of apertures formed in opposite side walls of said body;

c) a button received by said hollow body, said button having a proximal surface and a pair of openings formed in opposite side walls of said button;

d) a compression spring retained within said body, a first end of which abuts the blind end of said body, and a second end which is attached to a distal end of said button retaining said button within said body, such that pressure applied to said proximal surface of said button compresses said compression spring withdrawing said button into said body such that said cord lock is in said first, unlocked position, where said button openings are aligned with said body apertures forming an orifice therethrough, permitting said cord to be moved within said cord lock, repositioning said cord in a predetermined position, release of pressure upon said button such that said cord lock is in a second, locked position, wherein said apertures and openings are misaligned, resulting in the locking in place of said cord within said cord lock.

10. The hair fastener of claim 9, further comprising attachment of beads to said terminal ends of said cord for decorative purposes.

* * * * *